US009512810B2

(12) United States Patent
Shingu et al.

(10) Patent No.: US 9,512,810 B2
(45) Date of Patent: Dec. 6, 2016

(54) ELECTROMAGNETIC FUEL INJECTION VALVE

(75) Inventors: Akio Shingu, Chiyoda-ku (JP); Keishi Nakano, Chiyoda-ku (JP); Tsuyoshi Munezane, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 193 days.

(21) Appl. No.: 14/371,687

(22) PCT Filed: Apr. 18, 2012

(86) PCT No.: PCT/JP2012/060433

§ 371 (c)(1),
(2), (4) Date: Jul. 10, 2014

(87) PCT Pub. No.: WO2013/157089

PCT Pub. Date: Oct. 24, 2013

(65) Prior Publication Data

US 2015/0069152 A1 Mar. 12, 2015

(51) Int. Cl.

| | |
|---|---|
| ***F02M 63/00*** | (2006.01) |
| ***F02M 51/00*** | (2006.01) |
| ***F02M 51/06*** | (2006.01) |

(52) U.S. Cl.

CPC ..... *F02M 63/0017* (2013.01); *F02M 51/005* (2013.01); *F02M 51/061* (2013.01); *F02M 51/0682* (2013.01)

(58) Field of Classification Search

CPC F02M 51/005; F02M 51/061; F02M 51/0682; F02M 63/0017

USPC ..... 239/533.1–533.15, 585.1–585.5; 251/129.01–129.22

See application file for complete search history.

(56) References Cited

U.S. PATENT DOCUMENTS 7,293,757 B2 * 11/2007 Akabane ..... F02M 51/0682 239/585.5

2006/0214032 A1 9/2006 Akabane

FOREIGN PATENT DOCUMENTS

| | | | |
|---|---|---|---|
| CN | 1755093 | A | 4/2006 |
| JP | 04-315404 | A | 11/1992 |
| JP | 06-026418 | A | 2/1994 |
| JP | 09-065487 | A | 3/1997 |
| JP | 2004-140154 | A | 5/2004 |

(Continued)

OTHER PUBLICATIONS

Communication dated Dec. 21, 2015 from the Intellectual Property Office of the P.R. China issued in corresponding Application No. 201280069553.1.

(Continued)

*Primary Examiner* — Arthur O Hall
*Assistant Examiner* — Viet Le
(74) *Attorney, Agent, or Firm* — Sughrue Mion, PLLC; Richard C Turner

(57) ABSTRACT

An object of the present invention is to prevent a short circuit and disconnection between coil wires 52 in a crossing portion 52*c* in a solenoid device 5 of a fuel injection valve 1 that has a structure in which the coil wires 52 intersect with each other on a winding initiation side 52*a* and a winding completion side 52*b* of the coil wires 52.

A groove that is deeper in depth than the coil wire 52 is disposed in a bobbin 53, around which the coil wire 52 is wound, and the winding initiation side and the winding completion side of the coil wire is separated into upper and lower stages of a groove portion in the crossing portion.

5 Claims, 4 Drawing Sheets

(56) References Cited

FOREIGN PATENT DOCUMENTS

| | | | | |
|---|---|---|---|---|
| JP | 2006-090266 | A | | 4/2006 |
| JP | 2007-180175 | A | | 7/2007 |
| JP | 2007180175 | A | * | 7/2007 |

OTHER PUBLICATIONS

Communication dated Apr. 24, 2015, issued by the Korean Intellectual Property Office in counterpart Korean application No. 10-2014-7019329.
Communication dated Jun. 30, 2015, issued by the Japanese Patent Office in counterpart Application No. 2014511015.
International Search Report of PCT/JP2012/060433 dated Jul. 17, 2012.
Communication dated Feb. 9, 2016, from the Japanese Patent Office in counterpart application No. 2014-511015.

* cited by examiner

ELECTROMAGNETIC FUEL INJECTION VALVE

CROSS REFERENCE TO RELATED APPLICATIONS

This is a National Stage of International Application No. PCT/JP2012/060433 filed Apr. 18, 2012, the content of all of which is incorporated herein by reference in its entirety.

TECHNICAL FIELD

The present invention relates to an improvement of an electromagnetic fuel injection valve that is used mainly in a fuel supply system of an internal combustion engine.

BACKGROUND ART

FIG. 4 is a cross-sectional view illustrating an electromagnetic fuel injection valve in general according to the related art.

In the drawing, a fuel injection valve 1 is configured to include a valve seat 2, a movable valve body 3 that comes into and out of contact with the valve seat 2 to supply/block a fuel, a holder 4 that holds these, and a solenoid device 5 that drives the valve body 3. Herein, the valve body 3 has a valve portion 3*a* that comes into and out of contact with the valve seat 2, an armature 3*b* that is formed of a magnetic metal, and a pipe portion 3*c* that integrally couples the valve portion 3*a* and the armature 3*b*, and is pressed toward the valve seat 2 due to a pressing force of a spring 7 which is adjusted by a position of a rod 6.

In addition, the solenoid device 5 suctions the armature 3*b* against the pressing force of the spring 7, moves the valve body 3 upward, and has a core 51 that is formed of a magnetic metal, a coil 52 that is arranged on an outer circumference of the core 51, and a bobbin 53 that supports the coil 52.

Further, the core 51 fixed to a housing 9 by a cap 8, and the holder 4 is integrally mounted on the other end of the housing 9 by a ring 10.

In the fuel injection valve 1 described above, armature 3*b* is suctioned against the pressing force of the spring 7 when the coil 52 is energized and the valve portion 3*a* is unseated from the valve seat 2 such that the fuel is injected.

In the solenoid device 5 of the related art, a winding initiation side 52*a* and a winding completion side 52*b* of the coil wire 52 may have to intersect, allowing for windability of the coil wire 52 around the bobbin 53, as illustrated in FIG. 5.

JPA-2006-90266 is known as such an electromagnetic fuel injection valve 1 of the related art. JP-A-6-26418 shows a solenoid device in which the winding initiation side 52*a* and the winding completion side 52*b* of the coil wire 52 do not intersect.

CITATION LIST

Patent Literature

PTL 1: JP-A-2006-90266
PTL 2: JP-A-6-26418

SUMMARY OF INVENTION

Technical Problem

However, in a case where the winding initiation side 52*a* and the winding completion side 52*b* of the coil wire 52 intersect as described above, the coil wires 52 come into contact with each other in a crossing portion 52*c*, and friction occurs therebetween during exterior molding and cold loading. This may result in the peeling of the coating of the coil wire 52 and a short circuit and disconnection.

The present invention has been made in view of the above-described problems, and an object thereof is to hinder the contact between the coil wires 52 in the crossing portion 52*c* by using an easy and low-cost method and prevent the short circuit and the disconnection in a case where the coil wires 52 intersect on the winding initiation side 52*a* and winding completion side 52*b* of the coil wire 52 in the solenoid device 5 of the fuel injection valve 1.

Solution to Problem

In an electromagnetic fuel injection valve according to the present invention, a groove with a diameter larger than a diameter of a coil wire is disposed in a bobbin when a winding initiation side and a winding completion side of the coil wire intersect and are mounted on the bobbin, and the winding initiation side and the winding completion side of the coil wire are separated into, upper and lower stages in a groove portion in the crossing portion.

Advantageous Effects of Invention

According to the present invention, the winding initiation side and the winding completion side of the coil wire can be respectively separated into the upper stage and the lower stage of a step, and the contact between the coil wires in the crossing portion can be prevented.

BRIEF DESCRIPTION OF DRAWINGS

FIG. 2A is a plan view and FIG. 2B is a side view.

DESCRIPTION OF EMBODIMENTS

First Embodiment

Hereinafter, an embodiment of the present invention will be described with reference to FIGS. 1 to 3.

Figure 1:
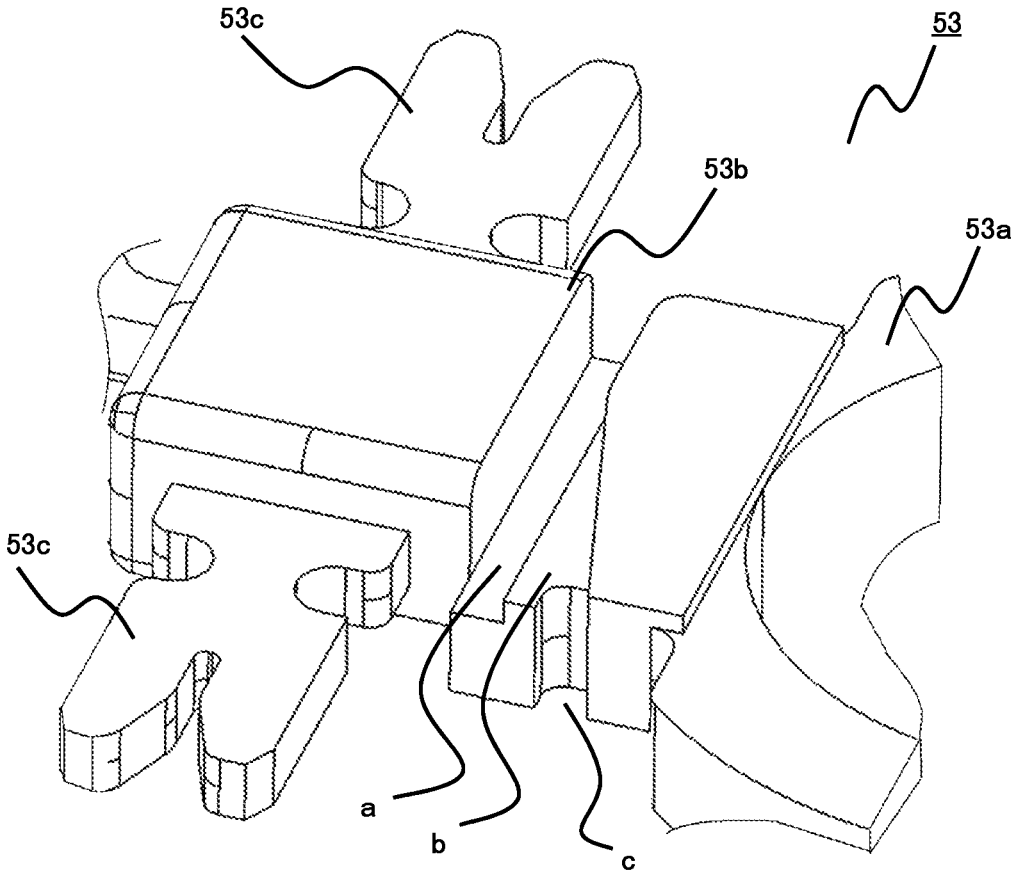
FIG. 1 is a perspective view illustrating a configuration of a bobbin that is a main part of an electromagnetic fuel injection valve according to a first embodiment of the present invention.
Figure 2A:
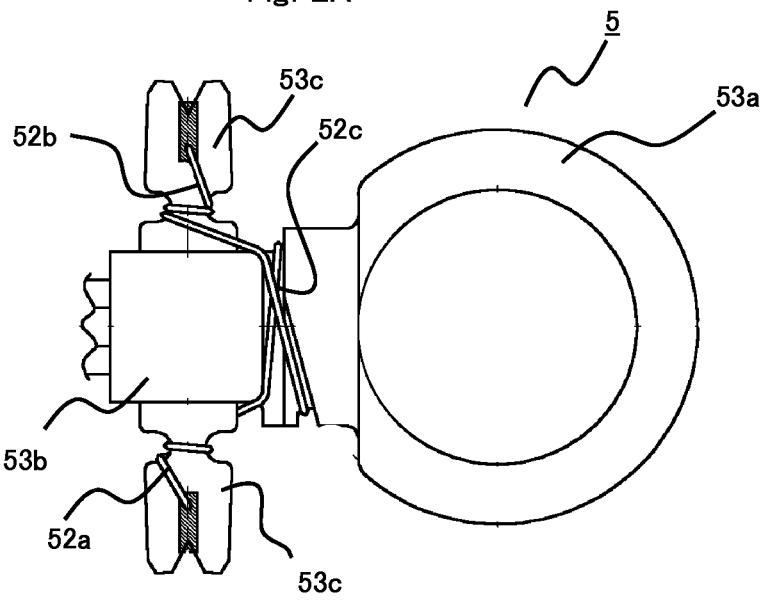
FIGS. 2A and 2B are views illustrating a main part configuration of the first embodiment of the present invention.
Figure 2B:
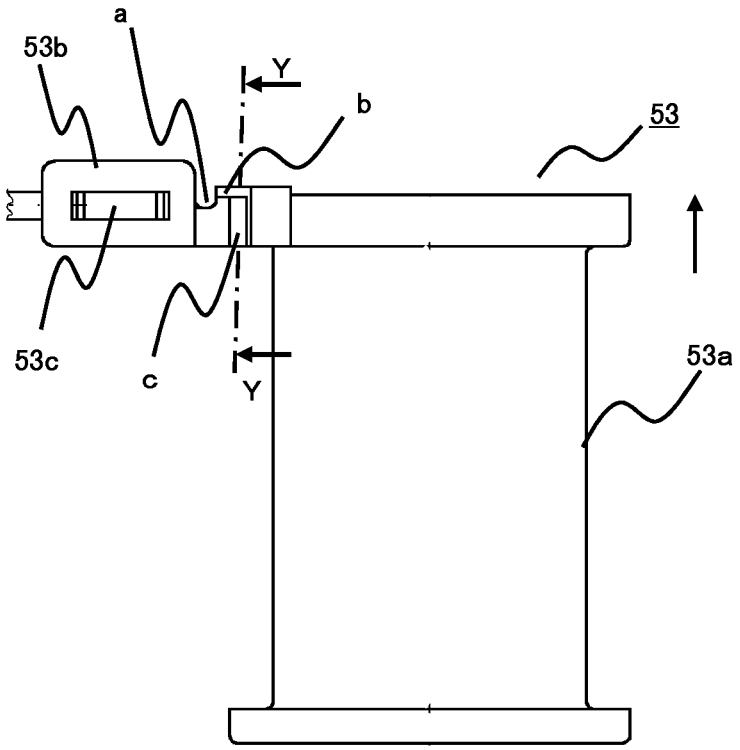

FIG. 1 is a perspective view illustrating a shape of a bobbin that is a main part of an electromagnetic fuel injection valve according to a first embodiment of the present invention. FIGS. 2A and 2B are a plan view illustrating a state where a coil wire is wound around the bobbin according to the first embodiment and a side view illustrating a stare where the coil wire is omitted. FIG. 3 is a cross-sectional view taken along line Y-Y, which illustrates the state where the coil wire is wound.

In the drawings, a bobbin 53 that constitutes a solenoid device 5 is molded by using an insulating resin material, and is configured to include a cylindrical portion 53*a* around which the coil wire is wound, a supporting portion 53*b* that is formed to protrude in a circumferential direction to an upper end of the cylindrical portion 53*a*, and a pair of tying portions 53*c* that are formed to protrude in opposite directions from the supporting portion 53*b*. A winding initiation side 52*a* and a winding completion side 52*b* of a coil wire 52 are respectively wound around the pair of tying portions 53*c*, and the coil wire 52 is fixed not to be loosened. In addition, a first groove a and a second groove b, which has a height that is equal to a wire diameter of the coil wire 52 from a bottom surface of the first groove a, are disposed along a circumferential direction of the cylindrical portion 53*a* on an upper surface of the supporting portion 53*b* and form two steps. Further, a notch c that is formed along an axial direction of the cylindrical portion 53*a* and communicates with the second groove b is disposed on a side surface of the supporting portion 53*b*.

In addition, the first groove a is formed such that the bottom surface thereof is positioned to be lower than upper surfaces of the tying portions 53*c* and to be higher than lower surfaces of the tying portions 53*c* as illustrated in FIG. 2B. In addition, the second groove b is formed such that a bottom surface thereof is lower than the upper surfaces of the tying portions 53*c*.

A cylindrical core is arranged in a hollow portion of the cylindrical portion 53*a*.

Based on this configuration, the winding initiation side 52*a* of the coil wire 52 is wound around the tying portion 53*c* and is wound around the cylindrical portion 53*a* through the first groove portion a, and the winding completion side 52*b* of the coil wire 52 is wound around the other tying portion 53*c* through the second groove portion h.

Figure 3:
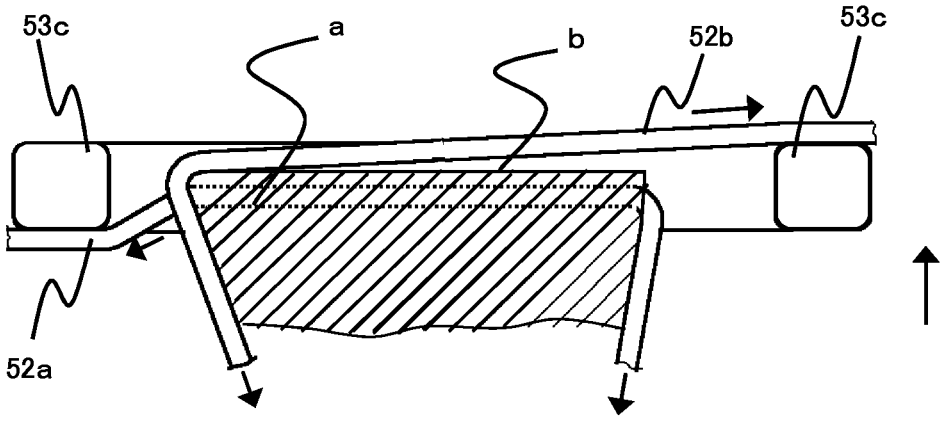
FIG. 3 is a cross-sectional view illustrating the main part configuration of the first embodiment of the present invention.
Figure 4:
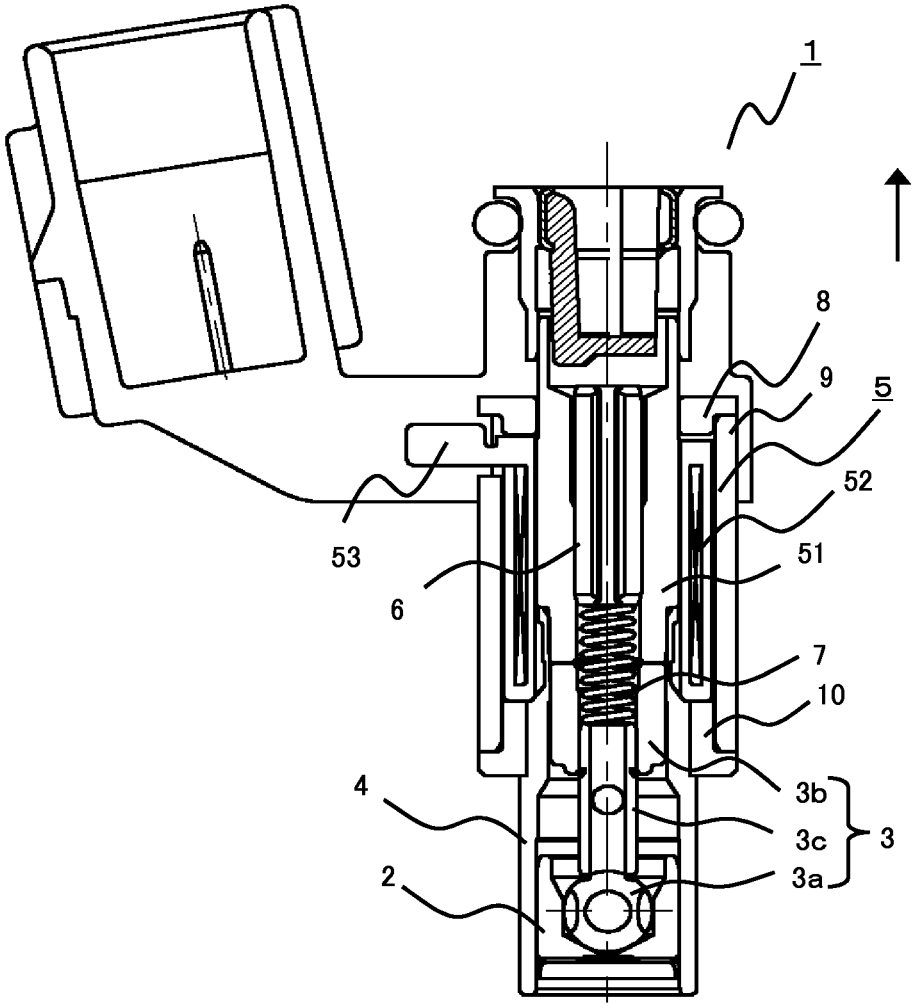
FIG. 4 is a cross-sectional side view illustrating a configuration of an electromagnetic fuel injection valve in general.
Figure 5A:
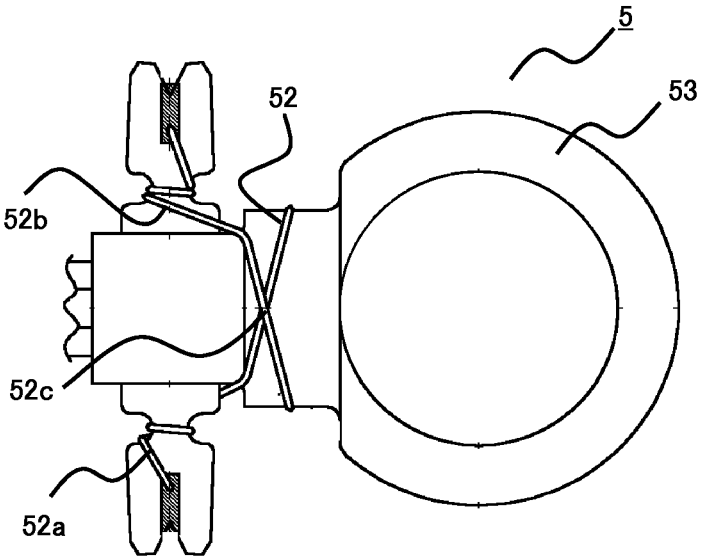
FIGS. 5A and 5B are a plan view and a side view illustrating a main part of an electromagnetic fuel injection valve of the related art.
Figure 5B:
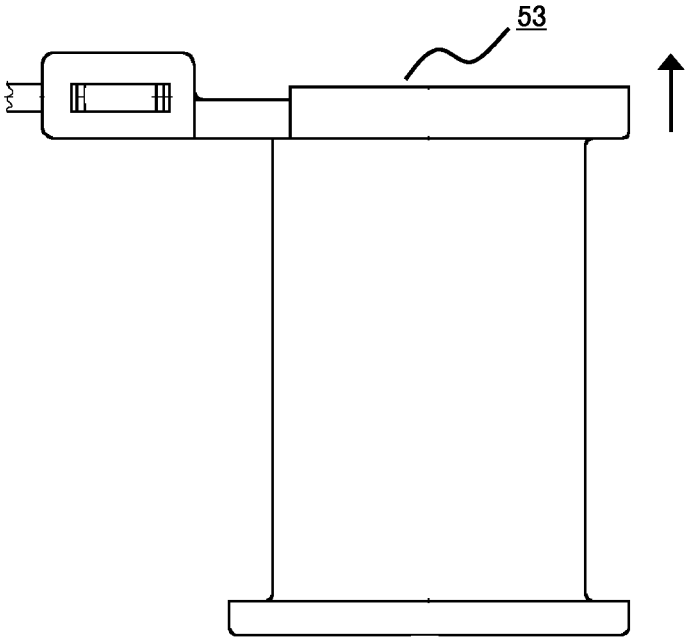

In this case, a part 52*c* where the winding initiation side 52*a* and the winding completion side 52*b* intersect with each other can support the coil wire 52 without coming into contact, as illustrated in FIG. 3, since the bottom surface of the first groove portion a is formed to be lower than the bottom surface of the second groove portion b by the wire diameter of the coil wire 52.

In addition, the bottom surface of the first groove portion a is disposed to be higher than the lower surfaces of the tying portions 53*c*, and thus the coil wire 52 is wound around an outer circumference of the cylindrical portion 53*a*, which is on a lower side, through the lower surfaces of the tying portions 53*c* and the bottom surface of the first groove portion a which is higher than these. The winding initiation side 52*a* is in a state of being pressed to the bottom surface of the first groove portion a due to tension during the winding. The winding completion side 52*b* of the coil wire 52 that is wound around the outer circumference of the cylindrical portion 53*a* is wound around the other tying portion 53*c* as the coil wire 52 is guided to an upper surface of the second groove portion b through the notch c which is placed in the bobbin 53.

Accordingly, the coil wire 52 can be prevented from falling off to the first groove portion a since the coil wire 52 is held in a state of being hooked onto the notch c. Furthermore, in this configuration, the coil wire 52 is tied through the upper surfaces of the tying portions 53*c* that are arranged above the second groove b, and thus the winding initiation side 52*a* and the winding completion side 52*b* are respectively pulled in a non-contact direction as illustrated in FIG. 3. As a result, the winding initiation side 52*a* and the winding completion side 52*b* of the coil wire 52 do not come into contact in the crossing portion 52*c*, and thus a short circuit and disconnection can be reliably prevented.

In the above-described embodiment, the second groove portion b is disposed to be shallower in depth than the first groove portion a. However, the second groove portion b may be required, and the contact of the coil wire 52 can also be prevented when the coil wire 52 passes along the notch on a side wall of the supporting portion 53*b*. In addition, although the winding initiation side 52*a* of the coil wire 52 is configured to be wired along the first groove portion a, the winding initiation side 52*a* may begin to be wound along the second groove portion b and the winding completion side 52*b* may be wired along the first groove portion a through below the winding initiation side 52*a*.

Furthermore, the first groove portion a, the second groove portion h, and the notch c may be configured to be inclined from the tying portions 53*c* in a tangential direction along the outer circumference of the cylindrical portion 53*a*. This is advantageous in that a part where the coil wire 52 is bent by the supporting portion 53*b* can be reduced.

The embodiment of the present invention can be modified and omitted appropriately within the scope of the present invention.

REFERENCE SIGNS LIST

1: Fuel injection valve
2: Valve seat
3: Valve body
4: Holder
5: Solenoid device
6: Rod
7: Spring
51: Core
52: Coil
53: Bobbin
52*a*: Winding initiation
52*b*: Winding completion side
52*c*: Crossing portion
53*a*: Cylindrical portion
53*b*: Supporting portion
53*c*: Tying portion
a: First groove
b: Second groove
c: Notch

The invention claimed is:

1. An electromagnetic fuel injection valve comprising:

a valve seat;

a movable valve body that is arranged to face the valve seat; and a solenoid device that suctions the movable valve body to unseat the movable valve body from the valve seat and injects a fuel, wherein the solenoid device includes a coil wire, a bobbin that supports the coil wire wound there around, and a core that forms a magnetic path, wherein a winding initiation side and a winding completion side of the coil wire intersect with each other, wherein the bobbin has a cylindrical portion around which the coil wire is wound, a pair of tying portions that fix the winding initiation side and the winding completion side of the coil wire, and a supporting portion that supports the pair of tying portions, wherein the supporting portion extends from the cylindrical portion in a radial direction with respect to the cylindrical portion, wherein a first groove having a diameter larger than a diameter of the coil wire and extending along a direction perpendicular to the radial direction is disposed in the supporting portion, wherein a second groove adjacent to a portion of the first groove is disposed in the supporting portion, wherein the coil wire passes through the first groove and the second groove, and wherein a crossing portion of the coil wire is separated into upper and lower stages by the first groove and the second groove.

2. The electromagnetic fuel injection valve according to claim 1, wherein a notch is disposed on a side surface of the supporting portion, and wherein the winding initiation side of the coil wire is wound around the cylindrical portion through the first groove, and the winding completion side of the coil wire passes through the second groove and is guided to the tying portion through the notch.

3. The electromagnetic fuel injection valve according to claim 2, wherein the first groove, the second groove, and the notch are inclined in the direction perpendicular to the radial direction.

4. The electromagnetic fuel injection valve according to claim 1, wherein a bottom surface of the first groove is disposed above lower surfaces of the pair of tying portions and below upper surfaces of the pair of tying portions with respect to an axial direction of the cylindrical portion, and a lower surface of the second groove is disposed below the upper surfaces of the tying portions with respect to the axial direction.

5. The electromagnetic fuel injection valve according to claim 1, wherein the winding initiation side of the coil wire passes through the first groove, and the winding completion side passes through the second groove.

* * * * *